US005415524A

United States Patent [19]

Gamble

[11] Patent Number: 5,415,524

[45] Date of Patent: May 16, 1995

[54] FLUID PROPULSION DEVICE

[76] Inventor: Christopher L. Gamble, P.O. Box 9154, Canoga Park, Calif. 91309

[21] Appl. No.: 69,357

[22] Filed: Jun. 1, 1993

[51] Int. Cl.[6] ..... F01D 5/00

[52] U.S. Cl. ..... 416/145; 416/190

[58] Field of Search ..... 416/189 R, 190, 144, 416/247 A, 146 R, 145

[56] References Cited

U.S. PATENT DOCUMENTS

| | | | |
|---|---|---|---|
| 1,141,337 | 6/1915 | Haydon | 416/144 |
| 2,366,795 | 1/1945 | Lamorsaux | 416/144 |
| 2,771,240 | 11/1956 | Gurin | 416/145 |
| 3,051,250 | 8/1962 | Jones | 416/189 B |
| 3,148,736 | 9/1964 | Skopyk | 416/189 B |
| 4,637,801 | 1/1987 | Schultz | 416/189 B |
| 5,256,037 | 10/1993 | Chatelain | 417/424.1 |

FOREIGN PATENT DOCUMENTS

| | | | |
|---|---|---|---|
| 0370363 | 4/1973 | Russian Federation | 416/145 |
| 0934061 | 6/1982 | Russian Federation | 416/145 |
| 0347964 | 5/1931 | United Kingdom | 416/145 |

*Primary Examiner*—Edward K. Look
*Assistant Examiner*—Mark Sgantzos
*Attorney, Agent, or Firm*—Gregory J. Nelson

[57] ABSTRACT

A fluid propulsion device having blades and a surrounding frustroconical housing which rotates with the blades to accelerate fluid flow through the device. The device may be part of a marine drive or part of a fluid pump or motor.

5 Claims, 2 Drawing Sheets

FLUID PROPULSION DEVICE

BACKGROUND THE INVENTION, FIELD OF INVENTION

The present invention relates to an axial flow device and more particularly relates to a fluid drive or propulsion unit of the type having a shroud extending around radially extending blades or propellers.

DESCRIPTION OF RELATED ART

Various axial flow fluid devices such as fans, pumps and propeller systems can be found in the prior art. Often these devices are for marine applications and have vanes or propellers which are circumferentially bounded by a fixed shroud in order to improve performance. Representative devices are shown in the following patents.

U.S. Pat. No. 4,192,461 relates to a propulsion device for use with water and air which has a nozzle with an internal surface. A curved surface merges into the internal surface and a narrowed throat in the internal surface is located toward the leading edge of the nozzle. A jacket surrounds the internal surface and an annular internal slot is located in the internal surface between the curved surface and narrowed throat communicating with the jacket. Fluid under pressure is supplied through the slot arrangement so that the fluid is ejected at an acute angle forming a propelling nozzle.

U.S. Pat. No. 4,509,925 discloses a marine vessel propeller having blades or fans which are bounded by circularly domed outer surfaces which co-act with a zone of a spherical surface formed at the inner surface of the nozzle. The result is that in all angular positions of the propeller vanes or blades, the gap or space formed between the outer edges of the vanes or blades and inner surface of the nozzle remains constant.

U.S. Pat. No. 3,244,135 shows a device for controlling movement of a ship. One or more foil-shaped members or flaps are pivotally connected to a duct surrounding the propeller. The foil-shaped members of each pair are parallel to each other and disposed at opposite ends of the diameter of the downstream opening of the duct. When the propeller is rotating, a stream of water is fed through the foil-shaped members through the duct. By varying the incidence of the foil-shaped members or flaps, the stream of water may be used to impart to the ship either an upward or downward fluid and a sideways movement for stability and steering.

U.S. Pat. No. 2,030,375 shows a marine propeller enclosed by a nozzle. The nozzle widens the front of the propeller to an opening which is larger than the exit opening behind the propeller. The body of the nozzle has a shape substantially such that the distance from the shaft to the exterior surface of the nozzle decreases from forward to aft.

U.S. Pat. No. 3,455,268 shows a non-symmetrical air foil shroud in combination with a propeller of a vessel. The axis of the shroud is maintained parallel to the axis of the propeller shaft and will provide directional control for vessels.

U.S. Pat. No. 3,179,081 provides an improved Kort nozzle rudder drive for combining the main propulsion of a vessel with improved steering by providing a tubular nozzle ring shaped according to the basic requirements of Kort nozzle rudder and which is mounted and carries a large diameter screw propeller rotatably internally of the nozzle ring.

U.S. Pat. No. 4,288,223 shows a tubular duct provided in connection with ship propellers with blade chips having barrier plates extending transversely therefrom. The tubular ducts are arranged to extend the barrier plates which in operation directs a fluid stream in substantially shock-free contact with the plates.

The foregoing are representative of various propulsion units including some with a circumferentially extending shroud or housing. The present invention differs in that the device has a converging or accelerating shroud which is not fixed with respect to the propeller blades but rather rotates with the propeller blades to accelerate the fluid flow through the device while lessening turbulence and shock.

SUMMARY OF THE INVENTION

Briefly, in accordance with the present invention, a plurality of radially extending blades are mounted on a central hub. The blades may be planar but preferably are rearwardly curved from the leading to the trailing edge. A housing extends circumferentially around the blades and is secured to the outer edges of the blades. The housing may be various shapes but in the preferred embodiment is frustroconical and rearwardly convergent, that is, the housing decreases in diameter in the direction of flow. The device may be used as a marine propulsion device, a pump, mixing device or any other application where it is desired to impart energy to fluid. In the alternative, the device may also be used as a motor with fluid flow directed through the device causing the device to impart rotation to an axially extending shaft. The device includes a dynamic balancing device which consists of a ring extending about the housing and defining an annular channel containing a balancing component such as mercury.

DESCRIPTION OF THE DRAWINGS

The above and other objects and advantages of the present invention will become more apparent from the following description, claims and drawings in which:

DESCRIPTION OF THE PREFERRED EMBODIMENT(S)

Figure 1:
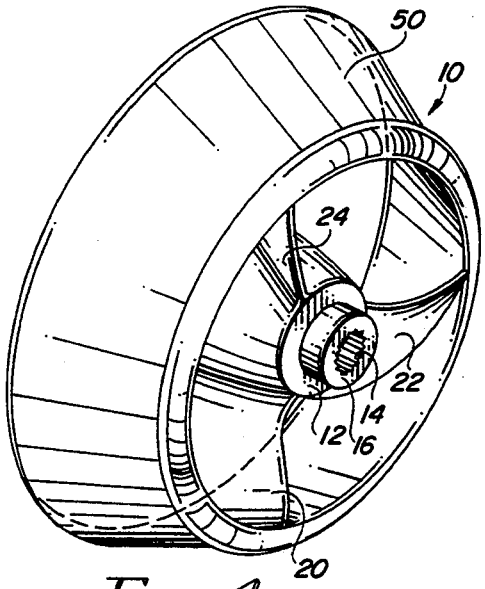
FIG. 1 is a perspective view of the propulsion device of the present invention.

As best seen in FIGS. 1 to 4, the propulsion device of the present invention is generally designated by the numeral 10 and includes a central hub 12 which defines an axially extending opening 14 having a plurality of spines 16 to secure the device to an axially extending shaft.

A plurality of blades, three are shown and designated 20,22 and 24, extend radially from the hub 12. Each of the blades has a leading edge 28, a trailing edge 30 and an outer or peripheral edge 32. Although the blades may be flat, preferably they are curved rearwardly from the leading to the trailing edge. The blades may have varying pitch angles but the pitch angle will depend on the particular application.

A fixed housing 50 extends circumferentially around the blades and is secured to the tips of the blades. The housing has a circumferentially extending wall 52 which converges from the housing inlet 54 to the outlet 56. The housing wall 52 may be curved but is shown as being frustroconical. The axial length "L+0 of the shroud may vary but it is preferred that the housing have sufficient length to enclose both the leading and trailing edge of the blades. The angle of convergence (alpha) of the shroud may also vary but again for applications such as jet drives it has been found that this angle should be approximately 20° to 45°

Figure 2:
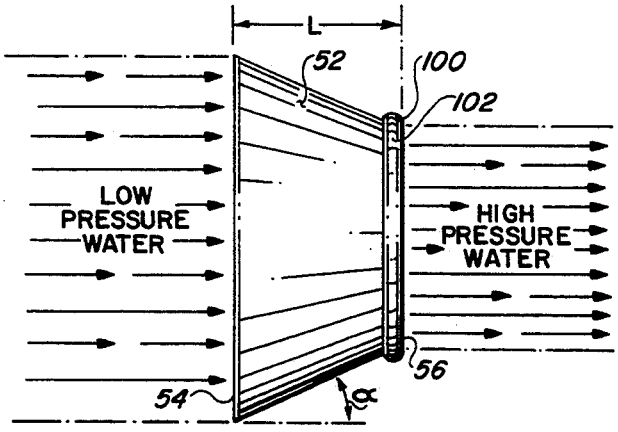
FIG. 2 is a side view of the propulsion device of the present invention.
Figure 3:
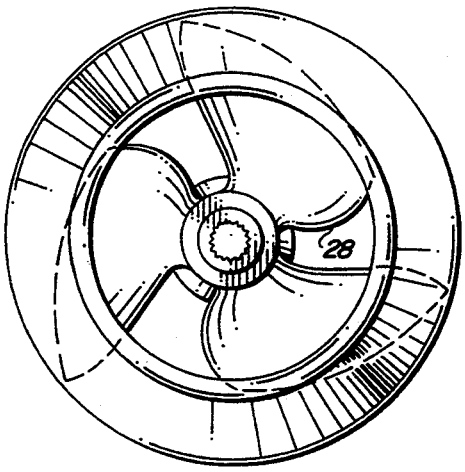
FIG. 3 is a rear view of the device of the present invention.

As the propulsion unit operates, fluid is drawn into the inlet at a lower pressure and energy is imparted by the rotating blades and housing, as indicated in FIG. 2. The fluid exits at discharge 56 at higher pressure.

Figure 8:
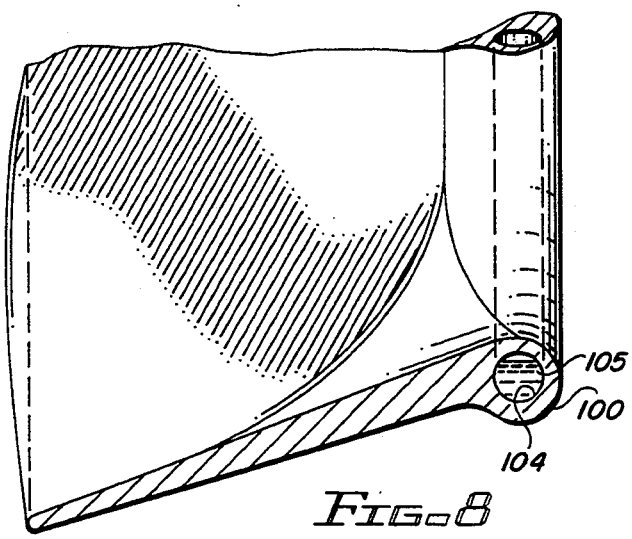
FIG. 8 is a sectional view of the ring taken along lines 8—8 of FIG. 6.
Figure 7:
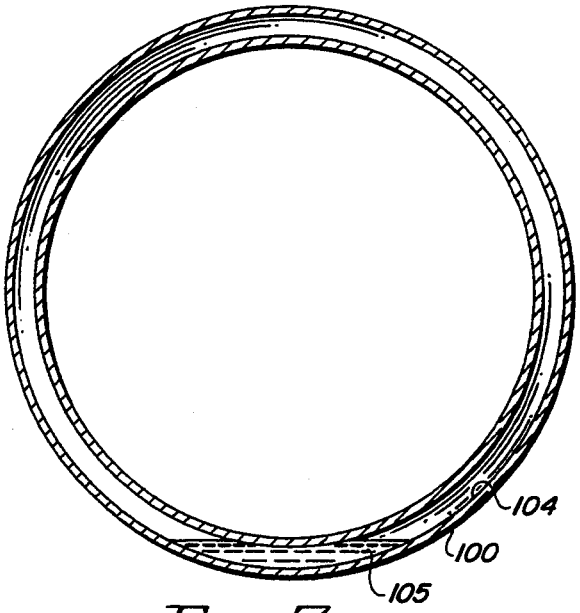
FIG. 7 is a sectional view of the dynamic balancing ring taken along line 7—7 of FIG. 6.

A particularly unique feature of the propulsion device of the present invention is the inclusion of a dynamic self-balancing ring 100. The ring 100 is best seen in FIGS. 7 and 8 and is shown attached or formed as an integral part of the housing 50 adjacent the discharge end 56 of the housing. The balancing ring 100 has an annular, tubular member 102 defining a continuously extending interior passageway 104. A dynamic balancing component 105 is contained within the passageway 104 and is free to move within the passageway. Upon an unbalanced condition arising during rotation, the balancing component will, through centrifugal force, move to a position within the passageway to counteract the unbalanced condition. The balancing component 105 is a high density material and may be solid material such as lead or steel balls or slugs. However, it is preferred the component consist of a flowable liquid such as mercury which will flow through the passageway. The passageway is sealed to prevent escape of the mercury or other balancing component.

Figure 5:
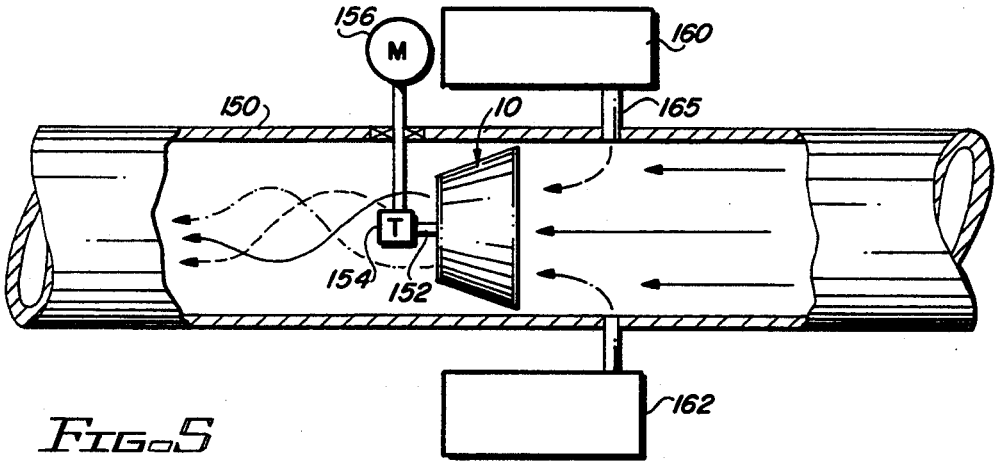
FIG. 5 is a view partly in schematic representing an installation of the present invention in a mixing chamber.

In FIG. 5, the propulsion device is shown mounted within a fluid conduit 150. The balancing device is secured to a shaft 152 at central hub 12. Shaft 152 is in driven engagement with transmission 154 which in turn is driven by motor 156. Fluid flow within the conduit 150 enters the inlet side of the propulsion device and exits the discharge sides at accelerated rate. In the embodiment of FIG. 5, the device is also used for mixing fluid components contained in tanks 160 and 162 into the flow within the conduit. As illustrated, each of the tanks or containers 160 and 162 have a conduit 165 communicating with the interior of the conduit upstream of the inlet to the propulsion device and the flow in the conduit 150 induces a flow from each of the containers 160 and 162.

Figure 4:
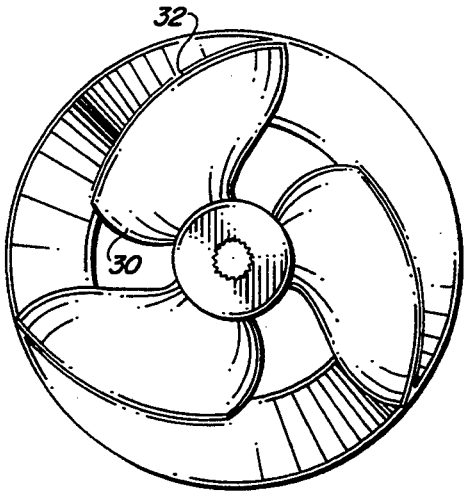
FIG. 4 is a front view looking from the inlet end of the propulsion device of the present invention.
Figure 6:
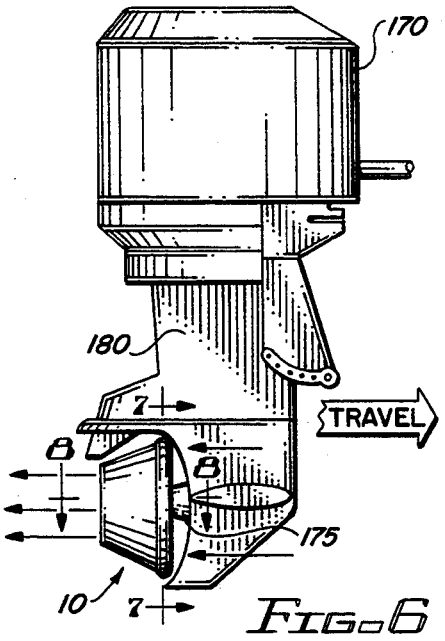
FIG. 6 is a side view of a marine engine with the propulsion device in driven relationship therewith.

As indicated above, the propulsion device has particular application as a drive for marine vessels. FIGS. 4, 6 and 8 illustrate the installation of the propulsion device in a marine engine 170. The propulsion device 10 at hub 14 is connected to shaft 175 of the engine. The water enters the inlet of the propulsion device, is accelerated and exits the discharge propelling the marine engine. Also as shown in this embodiment, the unit may be mounted on the pivotal body rudder 180 so that the housing may be turned to provide not only propulsion but also steering for the watercraft.

From the foregoing, it will be seen that the present invention provides a unique propulsion device which has a number of significant advantages including the advantage of being self-balancing. The device also provides a degree of safety in that the peripheral edges of the blades are not exposed minimizing possible injury or damage to persons or objects in the operating area. The propulsion device is highly efficient and can achieve high forward speeds. The chance of damage or breakage to the propellers is also minimized since the device is shrouded and also provides attendant safety benefits to aquatic life.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. An axial flow fluid propulsion device comprising:

(a) a hub defining a central axis;

(b) a plurality of blades extending radially from said hub, said blades each having a leading, trailing and an outer edge;

(c) a housing extending annularly about said axis and being substantially coextensive with said hub and being fixed with respect to said blades, said housing defining an inlet and converging axially to a discharge; and balancing means integral with said housing located adjacent said discharge, said balancing means including an annularly extending portion defining a continuous channel and a freely moving dynamic balancing component within said channel.

2. The device of claim 1 wherein said housing is generally frustroconical and has an axial length greater than the axial length of the said blades.

3. The device of claim 1 wherein said balancing component comprises liquid mercury.

4. The device of claim 1 further including mounting means for pivoting said device about a substantially vertical axis.

5. The device of claim 1 wherein said blades, housing and balancing means are integrally formed.

* * * * *